United States Patent [19]

Pollak et al.

[11] Patent Number: 4,595,048

[45] Date of Patent: Jun. 17, 1986

[54] TRANSFER OF IMPACT FORCE ONTO HEATING OR COOLING SURFACES, AND DEVICE FOR EFFECTING SUCH TRANSFER

[75] Inventors: Gerd Pollak, Gummersbach; Gerd Rabe, Meinerzhagen, both of Fed. Rep. of Germany

[73] Assignee: L. & C. Steinmüller GmbH, Gummersbach, Fed. Rep. of Germany

[21] Appl. No.: 653,503

[22] Filed: Sep. 21, 1984

[30] Foreign Application Priority Data

Sep. 23, 1983 [DE] Fed. Rep. of Germany ..... 3334456

[51] Int. Cl.[4] ..... F28G 7/00

[52] U.S. Cl. ..... 165/84; 165/95

[58] Field of Search ..... 165/84, 95; 122/379

[56] References Cited

U.S. PATENT DOCUMENTS

| | | | |
|---|---|---|---|
| 1,984,791 | 12/1934 | Finken | 165/84 |
| 3,997,000 | 12/1976 | Piela | 165/84 |
| 4,018,267 | 4/1977 | Tomasicchio | 165/84 |
| 4,457,361 | 7/1984 | Premel et al. | 165/84 |

FOREIGN PATENT DOCUMENTS

| | | | |
|---|---|---|---|
| 560705 | 9/1932 | Fed. Rep. of Germany | 165/84 |
| 2710153 | 9/1978 | Fed. Rep. of Germany . | |
| 1045678 | 11/1953 | France . | |
| 2044926 | 10/1980 | United Kingdom . | |
| 723790 | 3/1980 | U.S.S.R. | 165/84 |

*Primary Examiner*—Sheldon J. Richter

*Attorney, Agent, or Firm*—Becker & Becker, Inc.

[57] ABSTRACT

The transfer of impact force from a mechanically, pneumatically, or hydraulically driven knock or impact-beating device, which is mounted externally of a container that receives dust-laden, hot, and/or contaminated gases, onto bearing or cooling surfaces which are installed within the container, and which are to be intermittently cleaned. The impact force is indirectly transferred via the container wall to a striker which is pressed against an inner wall of the container by a resilient power accumulator. Preferably, the striker has a mass equal to that of the knocking element of the knock or impact-beating device. Pursuant to one embodiment of a device for effecting transfer of the impact force, the striker disposed within the container is guided within a connector-like inlet of the container body. The cover part associated with the inlet has a central bore and, on that side thereof facing the interior of the container, has a projection which coaxially surrounds the bore. A diaphragm wall rests against the projection, and is peripherally connected via weld projections with the inlet or with the cover part. The striker is provided with an equalization channel which connects the two pressure chambers. Via a spring which engages shoulders of the inlet, the striker is pressed against the diaphragm wall.

6 Claims, 2 Drawing Figures

TRANSFER OF IMPACT FORCE ONTO HEATING OR COOLING SURFACES, AND DEVICE FOR EFFECTING SUCH TRANSFER

BACKGROUND OF THE INVENTION

1. Field of the Invention

The present invention relates to the transfer of impact or knocking force from a mechanically, pneumatically, or hydraulically driven knock- or impact-beating device. This device is mounted externally of a container or tank which receives dust-laden, hot, and/or contaminated gases, onto heating or cooling surfaces that are installed within the container and are to be intermittently cleaned. The present invention also relates to a device for effecting such a transfer of the impact or knocking force.

2. Description of Prior Art

The necessity for cleaning heating or cooling surfaces which are installed within a container or tank, and around which circulate dust-laden, hot, and/or contaminated gases, results from the requirement to assure a constant heat transfer between a gas and the heating or cooling surfaces. A number of methods and devices for cleaning these heating or cooling surfaces by means of mechanically, hydraulically, or pneumatically driven knock or impact-beating devices are known. The cleaning effect is achieved in that the heating or cooling surfaces, and the deposits adhering thereto, undergo different accelerations due to the different inertias resulting from the transferred knocking or impact energy, as a result of which the deposits fall from the heating or cooling surfaces. The differences among the heretofore known methods and devices result from the operating conditions which exist in the containers which inclose the heating or cooling surfaces. Thus, for example to transfer the knocking or impact energy onto the heating or cooling surfaces, which are installed on the gas side of containers operated at a pressure that is greater than the surrounding atmospheric pressure, and which are used, for example, in a pressure-type coal gasification plant with a pressure of about 40 bar on the gas side; with the knock or impact-beating device being mounted externally of the pressure tank or container, a portion of the knocking or impact energy must be utilized to overcome the internal gas pressure of the container. One reason for disposing the impact-beating or knock device externally of the container is that the cooling surfaces within a pressure-type coal gasification container have gases with a temperature of about 1800° C. flowing therearound. Therefore, if the knock device were disposed within the container, additional cooling devices would be necessary for this device. U.S. Pat. No. 4,457,361 Premel et al, issued July 3, 1984, and belonging to the assignee of the present invention, discloses a knock or impact-beating device for such a pressure-containing container. With this patented device, by means of a pressure-equalizing connection element, nearly the entire applied knocking or impact energy is transferred to the heat exchanger surfaces which are to be cleaned.

A common feature of all such heretofore known devices is that the elements which transfer the impact or knocking energy must be sealed off. This is true whether a working cylinder is utilized within the container, as disclosed in German Offenlegungsschrift No. 24 11 133, whether striker rods are used which push through the container wall, as disclosed in German Offenlegungsschrift No. 22 40 250 or whether a connection element is used for a pressure tank to transfer the knocking or impact energy, as disclosed in the aforementioned U.S. Pat. No. 4,457,361 Premel et al issued July 3, 1984 and belonging to the assignee of the present invention. However, great drawbacks arise from these heretofore known devices since the seals thereof are exposed to high thermal or mechanical stresses due to the dust-laden and/or hot or corrosive gases. In cases in which the gases are furthermore contaminated, there exists the danger of environmental pollution, so that additional, expensive safety devices are necessary. Furthermore, the use of sealing elements entails close fits with small tolerances, so that when dust-laden gases flow around the heretofore known impact-beating or knock devices, the susceptibility to problems is necessarily great; as a result, these sealing elements must be frequently serviced. In addition, the advantage of simple servicing or replacement which a knock or impact-beating device which is mounted externally of a container has over a device disposed within the container again comes to nothing when the design of the knock device is provided with additional sealing means to avoid operation stoppages of a unit.

An object of the present invention therefore is to make possible the transfer of impact or knocking force from a mechanically, pneumatically, or hydraulically driven knock or impact-beating device, which is mounted externally of a container that receives dust-laden, hot, and/or contaminated gases, onto heating or cooling surfaces which are installed within the container and which are to be intermittently cleaned. According to features of the present invention, the sealing problems of the heretofore known knock or impact-beating devices can be avoided, and the impact or knocking energy can be transferred as completely as possible onto the heat exchange surfaces which are to be cleaned, even in the case of a container that is operated at a pressure greater than the surrounding atmospheric pressure.

BRIEF DESCRIPTION OF THE DRAWINGS

These objects, and other objects and advantages of the present invention, will appear more clearly from the following specification in conjunction with the accompanying drawings, in which.

SUMMARY OF THE INVENTION

Figure 1:
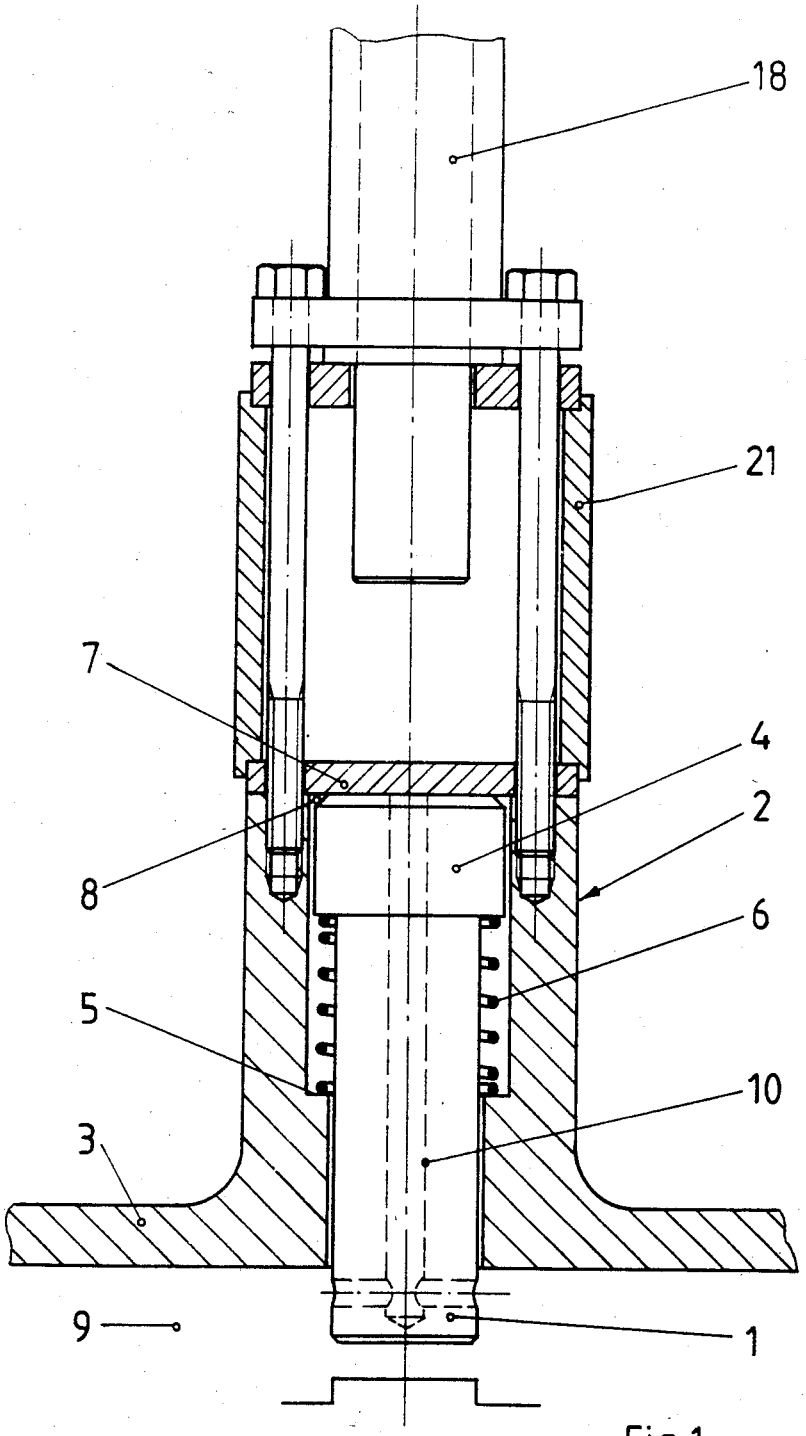
FIG. 1 is a cross-sectional view in elevation that schematically illustrates one possible embodiment of the inventive force transfer device, without the use of a diaphragm wall.

The present invention is characterized primarily in that the impact or knocking force is indirectly transferred via the container wall to a striker which is pressed against the inner wall of the container by a resilient power accumulator; preferably, the striker has a mass equal to that of the impact-beating or knocking element of the knock or impact-beating device, which is mounted externally of the container.

Pursuant to one inventive embodiment of the device for effecting transfer of the impact force, the striker disposed within the interior of the container is guided within a connector-like inlet of the container body, and is pressed against the cover associated with the connector-like inlet via a spring which is disposed between the head of the striker and the shoulder of the inlet; the striker is furthermore provided with an equalization channel which connects the two pressure chambers.

Pursuant to a second inventive embodiment of the device for effecting the transfer of the impact force, the striker disposed within the interior of the container is guided within a connector-like inlet of the container body, with the cover part which is associated with the inlet being provided with a central bore and, on that side thereof which faces the interior of the container, being provided with a projection which coaxially surrounds the bore; a diaphragm wall, the periphery of which is connected via weld projects with the connector-like inlet of the container body or with the cover part, rests against the projection; the striker is provided with an equalization channel which connects the two pressure chambers, and is pressed against the diaphragm wall by means of a spring which engages shoulders of the connector-like inlet of the container body.

As an additional safety device to protect against the sudden escape of gas from the container due to a leak in the impact force transferring container wall, or to control the operability of the wall, it is inventively proposed that the impact-beating or knock element of the knock or impact-beating device which is disposed externally of the container be located within a gastight chamber which is formed by the support element of the device and the cover associated with the connector-like inlet of the container body; the inner pressure of this gastight chamber is monitored by a pressure monitor.

The advantages achieved with the present invention consist in that all of the sealing elements can be eliminated due to the use of the container wall as the impact force transferring element for a striker integrated in the container wall. If the mass of the striker disposed within the interior of the container equals that of the knocking or impact-beating element of the knock or impact-beating device disposed externally of the container, an effective transfer of impact force is achieved, and a mechanical stressing of the impact force transferring wall portion of the container is extensively avoided. Due to the elimination of sealing elements, no close-tolerance fits are necessary either as was the case with the heretofore known devices, so that susceptibility to problems is considerably reduced. Servicing of the knock or impact-beating device which is disposed on the outside of the container, or replacement thereof, can be effected without additional expense, as a result of which the overall costs can be considerably reduced. Not only can the inventive transfer of impact force be realized in pressureless containers, but also in pressure-containing containers, since the striker is uniformly acted upon by pressure on all sides within a pressure-containing container. In order to nearly completely transfer the applied knocking or impact energy onto the heat exchange surfaces which are to be cleaned, the use of a resiliently oscillating diaphragm wall as an element which indirectly transfers the impact force is particularly suitable. In such a case, to reduce the stress of the diaphragm wall, for example due to the internal pressure of the container, the present invention provides for the disposition of the diaphragm wall against the projections which surround the central bore of a cover. By so doing, the material of the diaphragm is only subjected in a small region to the greater mechanical stresses resulting from the internal pressure of the container. The operability or reliability of this diaphragm wall or container wall can be checked in a simple manner accordingly, the moveable element of the impact-beating or knock device which is mounted externally of the container, is disposed within a gastight chamber, which is formed by the struck portion of the container wall and the support element of the knock or impact-beating device; the inner pressure of this gastight chamber is monitored by means of a pressure monitor.

DESCRIPTION OF PREFERRED EMBODIMENTS

Referring now to the drawings in detail, the knock or impact-beating device illustrated in FIG. 1 includes a striker 1, which beats against the heating or cooling surfaces, and which is disposed within a connector-like inlet 2 of the container body 3. The connector, for example, can be flanged onto the container body or can be welded thereto in a gastight manner. A spring 6 is disposed between the head 4 of the striker and the shoulder 5 of the guide member 2; the spring 6 presses the striker 1 against the cover 7. To equalize the pressure of the two pressure chambers 8 and 9, the striker 1 is additionally provided with an equalization chamber 10. The impact-beating or knock device 18, which is disposed externally of the container, for example, can be bolted on the outside against the flange cover 7. The knocking process is effected in that the striker of the knock or impact-beating device 18 beats against the flange cover 7, and the thus produced impact or knocking force is indirectly transferred via the cover 7 to the striker 1, which is pressed against the cover 7 by the spring 6. As a result, the striker 1 undergoes an acceleration, overcomes the return force of the spring 6, and beats against the cooling or heating surfaces which are to be cleaned.

Figure 2:
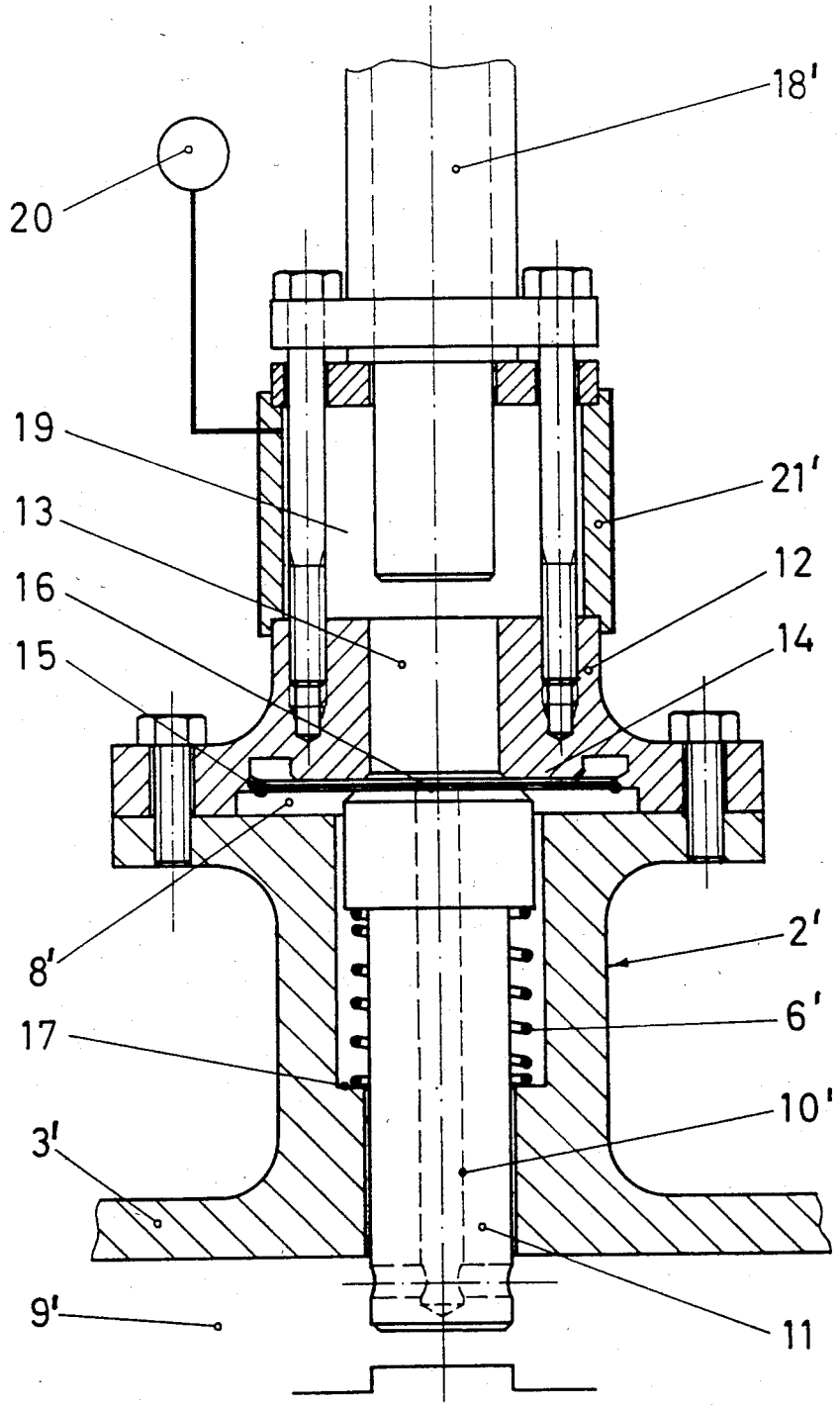
FIG. 2 is another cross-sectional view in elevation that schematically illustrates another possible embodiment of the inventive force transfer device, using a diaphragm wall and including a possible embodiment of the inventive safety device.

In the embodiment illustrated in FIG. 2, the impact force, which is produced externally of the container, is transferred to a diaphragm wall 16. Around a periphery thereof, the diaphragm wall 16 is welded in a gastight manner via weld projections 15 to the cover part 12. The diaphragm wall 16 rests against a projection 14 which coaxially surrounds the bore 13 of the flange cover 12. As a result of these measures, in pressure tanks having high internal pressures, the material of the diaphragm wall is subjected to great mechanical stress only in the small region of the bore 13. The striker 11, which is disposed within the guide member 2', is provided with an equalization channel 10' which connects the two pressure chambers 8' and 9'. The spring 6', which rests against shoulders 17 of the guide member 2', presses the striker 11 against the diaphragm wall 16. In the exemplary embodiment illustrated in FIG. 2, the bore 13 of the flange cover 12 serves to receive the striker of the impact-beating or knock device 18', which is disposed externally of the container or tank. For safety reasons, it may be appropriate to connect an extension of the guide member 2' in a gastight manner to the support element 21' of the impact-beating or knock device 18'. The internal pressure of the thus-formed chamber 19 can be monitored with the aid of a pressure monitor 20, so that detection of a gas leak involving the diaphragm wall 16 is signaled immediately. In particular, the danger of a sudden escape of gas from the container is inhibited.

The present invention is, of course, in no way restricted to the specific disclosure of the specification and drawings, but also encompasses any modifications within the scope of the appended claims.

What we claim is:

1. In a transfer arrangement to transmit impact force from a mechanically, pneumatically, or hydraulically driven knock or impact-beating device, which is mounted externally of a container which receives dust-laden, hot, and/or contaminated gases, onto heating or cooling surfaces which are installed within said container, and which are to be intermittently cleaned;

the improvement therewith comprises means for indirect transfer of said impact force via a wall of said container to a striker which is pressed against an inner wall of said container via a resilient power accumulator.

2. The transfer arrangement according to claim 1, in which said knock or impact-beating device has an element which performs knocking or impact-beating, said striker having a mass which is substantially equal to that of said last-mentioned element.

3. An apparatus for effecting transfer of impact force from a mechanically, pneumatically, or hudraulically driven knock or impact-beating device, which is mounted externally of a container which receives dust-laden, hot, and/or contaminated gases, onto heating or cooling surfaces which are installed within said container, and which are to be intermittently cleaned;

the improvement therewith comprising means for indirect transfer of said impact force via a wall of said container to a striker which is pressed against an inner wall of said container via a resilient power accumulator, said apparatus further comprising:

a container body, which includes a first pressure chamber;

a connector-like inlet formed on said container body, said inlet being internally provided with a shoulder, and including a second pressure chamber;

a striker guided within said inlet of said container body, said striker having a head which is directed toward said knock or impact-beating device; said striker being provided with an equalization channel to provide communication between said first and second pressure chambers;

a cover for said inlet of said container body, said cover being disposed between said head of said striker and said knock or impact-beating device, and forming said wall of said container via which said impact force is indirectly transferred to said striker; and a spring, which forms said resilient power accumulator, and which is disposed between said head of said striker and said shoulder of said inlet; said spring urging said head of said striker against said cover of said inlet.

4. An apparatus according to claim 3, which includes a support element connected to said connector-like inlet of said container body, said support element and said cover for said inlet forming a gastight chamber; in which said knock or impact-beating device includes an element which performs knocking or impact-beating, and which is disposed within said gastight chamber; and which includes a pressure monitor for monitoring the internal pressure of said gastight chamber.

5. An apparatus for effecting transfer of impact force from a mechanically, pneumatically, or hydraulically driven knock or impact-beating device, which is mounted externally of a container which receives dust-laden, hot, and/or contaminated gases, onto heating or cooling surfaces which are installed within said container, and which are to be intermittently cleaned;

the improvement therewith comprising means for indirect transfer of said impact force via a wall of said container to a striker which is pressed against an inner wall of said container by means of a resilient power accumulator, said apparatus further comprising:

a container body, which includes a first pressure chamber;

a connector-like inlet formed on said container body, said inlet being internally provided wth shoulder means, and including a second pressure chamber;

a striker guided within said inlet of said container body, said striker having a head which is directed toward said knock or impact-beating device; said striker being provided with an equalization channel to provide communication between said first and second pressure chambers;

a cover means for said inlet of said container body, said cover means being disposed between said head of said striker and said knock or impact-beating device, and being provided with a central bore; said cover means has a side which faces the interior of said container, and hence said striker, said side being provided with a first projection, which encircles said central bore;

second projections provided on one of said cover means and said inlet of said container body essentially radially outwardly of said first projection of said cover means;

a diaphragm wall having a periphery which is connected to said second projections; said diaphragm wall rests against said first projection of said cover means, and is disposed between said heat of said striker and said cover means, covering said central bore adjacent to said head of said striker; said diaphragm wall forms said wall of said container via which said impact force is directly transferred to said striker; and a spring, which forms said resilient power accumulator, and which is disposed between said heat of said striker and said shoulder means of said inlet; said spring urging said head of said striker against said diaphragm wall.

6. An apparatus according to claim 5, which includes a support element connected to said connector-like inlet of said container body, said support element and said cover for said inlet forming a gastight chamber; in which said knock or impact-beating device includes an element which performs knocking or impact-beating, and which is disposed within said gastight chamber; and which includes a pressure monitor for monitoring the internal pressure of said gastight chamber.

* * * * *